US012209759B2

(12) United States Patent
Leezer

(10) Patent No.: US 12,209,759 B2
(45) Date of Patent: Jan. 28, 2025

(54) PORTABLE DEHUMIDIFIER WITH REMOTE MOISTURE SENSOR

(71) Applicant: Midea Group Co., Ltd., Foshan (CN)

(72) Inventor: David Leezer, LaGrange, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 443 days.

(21) Appl. No.: 17/559,404

(22) Filed: Dec. 22, 2021

(65) Prior Publication Data

US 2023/0194106 A1 Jun. 22, 2023

(51) Int. Cl.

| | |
|---|---|
| ***F24F 1/0358*** | (2019.01) |
| ***F24F 1/022*** | (2019.01) |
| ***F24F 1/028*** | (2019.01) |
| ***F24F 1/04*** | (2011.01) |
| *F24F 110/22* | (2018.01) |

(52) U.S. Cl.

CPC ..... *F24F 1/0358* (2019.02); *F24F 1/022* (2013.01); *F24F 1/028* (2019.02); *F24F 1/04* (2013.01); *F24F 2110/22* (2018.01); *F24F 2221/125* (2013.01); *F24F 2221/56* (2013.01)

(58) Field of Classification Search

CPC .. F24F 1/0358; F24F 1/022; F24F 1/04; F24F 2110/22; F24F 2221/125; F24F 11/86; F24F 3/1405; F24F 2003/144; F24F 2003/1446; F24F 2110/20

See application file for complete search history.

(56) References Cited

U.S. PATENT DOCUMENTS

| | | | | |
|---|---|---|---|---|
| 5,729,994 | A * | 3/1998 | Mukaiyama | F24F 5/0092 62/282 |
| 6,199,428 | B1 | 3/2001 | Estevez-Garcia et al. | |
| 6,210,566 | B1 | 4/2001 | King | |
| 6,370,902 | B1 | 4/2002 | De' Longhi | |
| 7,490,706 | B2 * | 2/2009 | Robertson | B65H 75/42 191/12.2 A |
| 7,671,754 | B2 | 3/2010 | Heilmann et al. | |
| 7,821,411 | B1 | 10/2010 | Ward | |
| 8,172,154 | B1 | 5/2012 | Figley et al. | |

(Continued)

FOREIGN PATENT DOCUMENTS

| | | |
|---|---|---|
| CN | 1590879 A | 3/2005 |
| CN | 2926888 Y | 7/2007 |

(Continued)

OTHER PUBLICATIONS

Sullens, Tavia L., United States Patent and Trademark Office, Final Office Action issued in U.S. Appl. No. 16/875,847, 35 pages, dated Apr. 20, 2023.

(Continued)

*Primary Examiner* — Lionel Nouketcha
(74) *Attorney, Agent, or Firm* — Gray Ice Higdon

(57) ABSTRACT

A portable dehumidifier includes a remote moisture sensor that is capable of being physically positioned at a location that is remote from a portable housing of the portable dehumidifier to sense moisture at the location. In some instances, the remote moisture sensor may be positioned near or on clothing in order to sense the dryness of the clothing and/or positioned near or on floors, walls, furniture, etc., in order sense the dryness thereof in connection with water damage restoration.

27 Claims, 7 Drawing Sheets

(56) References Cited

U.S. PATENT DOCUMENTS

| | | | | |
|---|---|---|---|---|
| 8,181,939 | B2 | 5/2012 | Yoon | |
| 8,196,422 | B2 | 6/2012 | Ritchey | |
| 8,292,117 | B2 | 10/2012 | Guibert | |
| 8,869,548 | B2 | 10/2014 | Piccione | |
| 8,994,812 | B2 | 3/2015 | Giordano et al. | |
| 9,074,812 | B2 | 7/2015 | Rowland | |
| 9,958,182 | B1 | 5/2018 | Rimmer | |
| 10,031,041 | B2 | 7/2018 | Franz et al. | |
| 10,458,730 | B2 | 10/2019 | Lorang et al. | |
| 10,473,355 | B2 * | 11/2019 | O'Brien | F24F 12/006 |
| 10,578,481 | B2 | 3/2020 | Myeong et al. | |
| 10,677,479 | B2 | 6/2020 | Andersson | |
| 10,788,230 | B2 * | 9/2020 | Williams | F24F 11/30 |
| 10,830,490 | B2 | 11/2020 | Rokade et al. | |
| 10,900,676 | B2 | 1/2021 | Swanson et al. | |
| 11,077,399 | B2 | 8/2021 | Choi et al. | |
| 2003/0066298 | A1 | 4/2003 | Yang | |
| 2004/0040322 | A1 | 3/2004 | Engel | |
| 2006/0258916 | A1 * | 11/2006 | Pietersen | A61F 13/84 600/483 |
| 2014/0102296 | A1 * | 4/2014 | Pendergrass | F24F 11/0008 95/10 |
| 2014/0150488 | A1 | 6/2014 | Black et al. | |
| 2015/0276241 | A1 * | 10/2015 | Jeon | F24F 3/1405 62/126 |
| 2016/0153824 | A1 | 6/2016 | Myeong | |
| 2017/0185276 | A1 | 6/2017 | Lee et al. | |
| 2017/0336093 | A1 | 11/2017 | Huang et al. | |
| 2018/0172290 | A1 | 6/2018 | Zhou | |
| 2018/0372371 | A1 * | 12/2018 | DeMonte | F24F 13/32 |
| 2019/0055691 | A1 * | 2/2019 | Tong | D06F 57/00 |
| 2019/0137121 | A1 | 5/2019 | Swanson et al. | |
| 2019/0137131 | A1 | 5/2019 | Sako et al. | |
| 2019/0232213 | A1 | 8/2019 | Dios | |
| 2019/0323714 | A1 | 10/2019 | Cui | |
| 2020/0011556 | A1 * | 1/2020 | Williams | F24F 11/30 |
| 2020/0061532 | A1 | 2/2020 | Yoon et al. | |
| 2020/0116392 | A1 | 4/2020 | Gardner et al. | |
| 2020/0182490 | A1 | 6/2020 | Li | |
| 2021/0332990 | A1 | 10/2021 | Yang et al. | |
| 2021/0333010 | A1 | 10/2021 | Yang et al. | |
| 2023/0018141 | A1 | 1/2023 | Derossett | |
| 2023/0314013 | A1 | 10/2023 | Derossett et al. | |

FOREIGN PATENT DOCUMENTS

| | | | |
|---|---|---|---|
| CN | 201411571 | Y | 2/2010 |
| CN | 202747574 | U | 2/2013 |
| CN | 105387534 | A | 3/2016 |
| CN | 106482317 | A | 3/2017 |
| CN | 206338879 | U | 7/2017 |
| CN | 107238146 | A | 10/2017 |
| CN | 207065748 | U | 3/2018 |
| CN | 207094850 | U | 3/2018 |
| CN | 108244846 | A | 7/2018 |
| CN | 109425043 | A | 3/2019 |
| CN | 110748988 | | 2/2020 |
| CN | 111140989 | A | 5/2020 |
| CN | 211476138 | U | 9/2020 |
| CN | 110079982 | B | 4/2021 |
| CN | 213713516 | U | 7/2021 |
| EP | 2832920 | A1 | 2/2015 |
| EP | 3872407 | A1 | 9/2021 |
| JP | S62136213 | U | 8/1987 |
| JP | IPH0665360 | B2 | 8/1994 |
| JP | 2591726 | B2 | 3/1997 |
| JP | 2009089995 | A | 4/2009 |
| JP | 2013240406 | A | 12/2013 |
| JP | 5887478 | B2 | 3/2016 |
| JP | 3221820 | U | 6/2019 |
| KR | 20150103909 | A | 9/2015 |
| KR | 20160013477 | A | 2/2016 |
| KR | 20160054723 | A | 5/2016 |
| WO | WO9314353 | A1 | 7/1993 |
| WO | WO2006013653 | A1 | 2/2006 |

OTHER PUBLICATIONS

U.S. Patent and Trademark Office, Office Action issued in U.S. Appl. No. 16/764,772 dated May 26, 2022.

Putri, Dewi et al., Design and Performance Analysis of Smart Roof Clothesline System Based on Microcontroller by Smartphone Application, School of Electrical Engineering, Telkom University, Dec. 20, 2018.

Belin, Belin Brand BL-890D 90L (150) Pint R410a without water tank drainage directly commercial industrial dehumidifier, alibaba.com, Retrieved from: https://www.alibaba.com/product-detail/BELIN-brand-BL-890D-90L-150Pint_60447146179.html?spm=a2700.7724857.normal_offer.d_title.79fb5cd7iHcdoL, Retrieved on Mar. 23, 2021.

Innovative Dehumidifier Systems, Tankless Dehumidification System Independent of Hvac, IW25-4 In Wall/ On Wall Dehumidifier, Retrieved from: https://www.innovativedehumidifiers.com/dehumidification-system/, Retrieved on Mar. 23, 2021.

Sheth, Sarang, The Foldable Dehumidifier Has a Bellow-Shaped Water Tank That Expands as it Fills Up, Yanko Design, GREE Electric Appliances Inc., www.yankdesign.com/author/sarangsheth, Oct. 24, 2019.

International Search Report and Written Opinion issued in Application No. PCT/CN2020/086640 dated Jan. 13, 2021.

U.S. Patent and Trademark Office, Office Action issued in U.S. Appl. No. 16/764,772 dated Sep. 21, 2021.

Related Applications Transmittal dated Apr. 1, 2022.

Sullens, Tavia L., United States Patent and Trademark Office, Notice of Allowance issued in U.S. Appl. No. 16/875,847, 30 pages, dated Feb. 21, 2024.

U.S. Appl. No. 16/764,772, filed May 15, 2020.

U.S. Appl. No. 16/875,847, filed May 15, 2020.

U.S. Appl. No. 17/559,404, filed Dec. 22, 2021.

U.S. Appl. No. 17/708,873, filed Mar. 30, 2022.

Sullens, Tavia L, United States Patent and Trademark Office, Office Action issued in U.S. Appl. No. 16/875,847, 31 pages, dated Sep. 1, 2022.

United States Patent and Trademark Office; Final Rejection Issued in U.S. Appl. No. 16/764,772; 42 pages; dated Dec. 16, 2022.

Sullens, Tavia L., United States Patent and Trademark Office, Non-Final Office Action issued in U.S. Appl. No. 16/875,847, 43 pages, dated Sep. 8, 2023.

Tadesse, Martha, United States Patent and Trademark Office, Notice of Allowance issued in U.S. Appl. No. 16/764,772, 23 pages, dated Jul. 6, 2023.

Sanks, Schyler S., United States Patent and Trademark Office, Non-Final Office Action issued in U.S. Appl. No. 17/708,873, 83 pages, dated May 22, 2024.

* cited by examiner

PORTABLE DEHUMIDIFIER WITH REMOTE MOISTURE SENSOR

BACKGROUND

Portable dehumidifiers are used in many homes to reduce the humidity in an interior environment. Portable dehumidifiers typically include a refrigeration circuit including an evaporator that absorbs heat, a condenser that expels heat, and a compressor that circulates refrigerant through the circuit. A fan draws moist air into the dehumidifier and over the evaporator to cool the air and cause water vapor in the air to condense on the surface of the evaporator. The now dehumidified air then continues across the condenser to reheat the air, prior to exiting the dehumidifier. Condensed water may also be collected in a tank for later disposal by a user, or in some instances, the collected water may be diverted directly to a drain, with a condensate pump used in some instances when an insufficient head exists to induce drainage through gravity alone. Many portable dehumidifiers also include a user interface that enables a user to set a particular humidity level as a setpoint, so that a portable dehumidifier will shut off once the desired humidity level is reached and turn back on once the humidity level rises again.

Portable dehumidifiers are often used in areas of a home that are routinely subjected to higher humidity levels such as basements and bathrooms, as excessive humidity can lead to mold growth and structural damage in a home. However, in many geographical regions, excessive humidity can be seasonal, as humidity generally drops during colder winters due to the fact that colder air is capable of retaining less water vapor than warmer air. Dehumidifiers may also be useful after flooding or water leaks in order to evaporate standing water and/or dry carpets or rugs. As such, the portability of such dehumidifiers is often a benefit since they can be moved to different areas of the home as needed, and may also be stored away when not in use.

In addition, in some regions of the world in which laundry is often hung up and air dried rather than dried in a laundry dryer, portable dehumidifiers may be used to accelerate the drying process, as the reduction of humidity in the air in a room will generally result in shorter drying times.

Conventional portable dehumidifiers, however, generally rely on humidity readings obtained from a moisture sensor that is integrated into a main housing, so the presence of wet clothing or standing water in a room in which a portable dehumidifier is running only has a tangential effect on the operation of the portable dehumidifier. As a result, if the surrounding air is relatively dry, a portable dehumidifier may shut off based upon sensing a lack of humidity in the air, even if wet clothes and/or standing water are nearby. One manner of addressing this problem is to set the humidity level at a low setpoint that is beyond the capability of the dehumidifier to reach so that the portable dehumidifier never cycles off. However, this solution is not optimal in many circumstances because unless the user remembers to reset the humidity level, the portable dehumidifier will continue to run long after the clothes are dry or the standing water has evaporated, wasting energy and potentially shortening the life of the portable dehumidifier.

SUMMARY

The herein-described embodiments address these and other problems associated with the art by providing a portable dehumidifier utilizing a remote moisture sensor that is capable of being physically positioned at a location that is remote from a portable housing of the portable dehumidifier to sense moisture at the location. In some instances, the remote moisture sensor may be positioned near or on clothing in order to sense the dryness of the clothing and/or positioned near or on floors, walls, furniture, etc., in order sense the dryness thereof in connection with water damage restoration.

Therefore, consistent with one aspect of the invention, a portable dehumidifier may include a portable housing including an air inlet and an air outlet, a refrigeration circuit disposed in the housing and including a condenser, an evaporator, and a compressor, a fan driven by a motor and configured to draw air in through the air inlet, past the evaporator and the condenser, and out the air outlet, a remote moisture sensor configured to be physically positioned at a location that is remote from the portable housing to sense moisture at the location, and a controller coupled to the compressor and the motor and in communication with the remote moisture sensor, the controller configured to drive the refrigeration circuit with the compressor and drive the fan with the motor in response to moisture sensed by the remote moisture sensor.

Some embodiments may also include a handle coupled to the portable housing for carrying the portable housing. In addition, some embodiments may further include a plurality of wheels supporting the portable housing. Some embodiments may further include a power cord configured to be removably plugged into a power outlet. Some embodiments may also include a condensation tank coupled to the housing and positioned to collect condensate generated by the evaporator.

In addition, in some embodiments, the remote moisture sensor includes a conductivity sensor, a humidity sensor, or a continuity sensor. In some embodiments, the remote moisture sensor includes a clip and/or a hook to support the remote moisture sensor at the location. In addition, in some embodiments, the remote moisture sensor is integrated into a coat hanger. Moreover, in some embodiments, the remote moisture sensor is coupled to the portable housing through a cord. In some embodiments, the portable housing includes a cord retractor configured to automatically retract the cord into the portable housing. Moreover, in some embodiments, the portable housing includes a cord storage loop for storing the cord on the portable housing. In some embodiments, the remote moisture sensor is in wireless communication with the controller.

In addition, in some embodiments, the controller is configured to operate in at least dehumidify and dry modes such that when in the dehumidify mode the controller controls the compressor and the motor based upon a room humidity control algorithm, and when in the dry mode the controller controls the compressor and the motor based upon a dry control algorithm.

In some embodiments, the portable housing includes a dock configured to receive the remote moisture sensor. Some embodiments may further include a dock sensor coupled to the controller and configured to detect whether the remote moisture sensor is docked in the dock.

Also, in some embodiments, the controller is configured to automatically switch from the dehumidify mode to the dry mode in response to the dock sensor detecting the remote moisture sensor being undocked from the dock. In some embodiments, the controller is configured to automatically switch from the dry mode to the dehumidify mode in response to the dock sensor detecting the remote moisture sensor being docked to the dock. In addition, in some embodiments, the controller is configured to use the remote moisture sensor as a room humidity sensor when in the dehumidify mode.

In addition, some embodiments may further include a room humidity sensor coupled to the portable housing and coupled to the controller. Moreover, in some embodiments, the controller is configured to only use the room humidity sensor when operating in the dehumidify mode, and only use the remote moisture sensor when operating in the dry mode. Further, in some embodiments, the controller is configured to concurrently use both of the room humidity sensor and the remote moisture sensor to control the compressor and the motor.

Also, in some embodiments, the remote moisture sensor is positionable on or proximate clothing to sense a moisture level on or proximate the clothing. Further, in some embodiments, the remote moisture sensor is positionable on a wall, a floor and/or a piece of furniture.

In some embodiments, the controller is configured to automatically shut off the compressor and the motor in response to an output of the remote moisture sensor meeting a dry mode complete criterion. Also, in some embodiments, the controller is configured to generate a user notification in response to an output of the remote moisture sensor meeting a dry mode complete criterion.

Consistent with another aspect of the invention, a portable dehumidifier may include a portable housing including an air inlet and an air outlet, a refrigeration circuit disposed in the housing and including a condenser, an evaporator, and a compressor, a fan driven by a motor and configured to draw air in through the air inlet, past the evaporator and the condenser, and out the air outlet, a moisture sensor positioned on a bottom of the portable housing and configured to sense moisture on a surface upon which the portable housing is supported, and a controller coupled to the compressor and the motor and in communication with the moisture sensor, the controller configured to drive the refrigeration circuit with the compressor and generate a user notification in response to moisture sensed by the moisture sensor.

In some embodiments, the moisture sensor is a first moisture sensor disposed on a first portion of the bottom of the portable housing, and the portable dehumidifier includes one or more additional moisture sensors disposed at different portions of the bottom of the portable housing.

In addition, some embodiments include various methods of operating a portable dehumidifier having the various characteristics described above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In some embodiments consistent with the invention, a portable dehumidifier utilizes a remote moisture sensor that is capable of being physically positioned at a location that is remote from a portable housing of the portable dehumidifier to sense moisture at the location. In some instances, the remote moisture sensor may be positioned near or on clothing in order to sense the dryness of the clothing and/or positioned near or on floors, walls, furniture, etc., e.g., in connection with water damage restoration. In some embodiments, a portable dehumidifier may also include one or more moisture sensors capable of detecting a potential water damage condition such as a leak, flooding or a drain blockage to enable a user to be alerted to the condition. In some instances, for example, a portable dehumidifier may include one or more moisture sensors disposed on a bottom of a portable housing thereof to sense moisture on a surface upon which the portable housing is supported, and if detected, generate a user notification.

Figure 1:
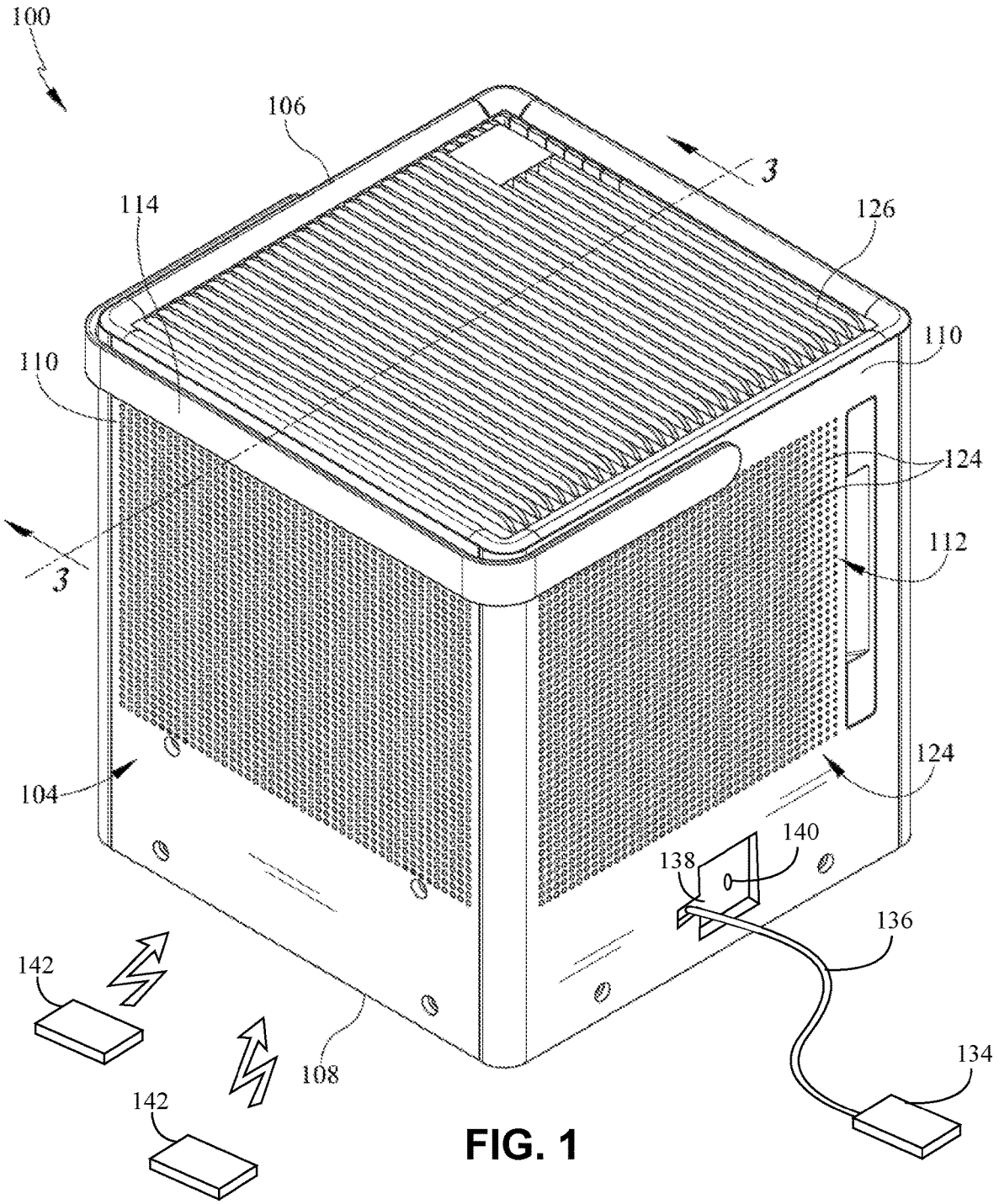
FIG. 1 is a perspective view of a portable dehumidifier incorporating a remote moisture sensor consistent with some embodiments of the invention.
Figure 2:
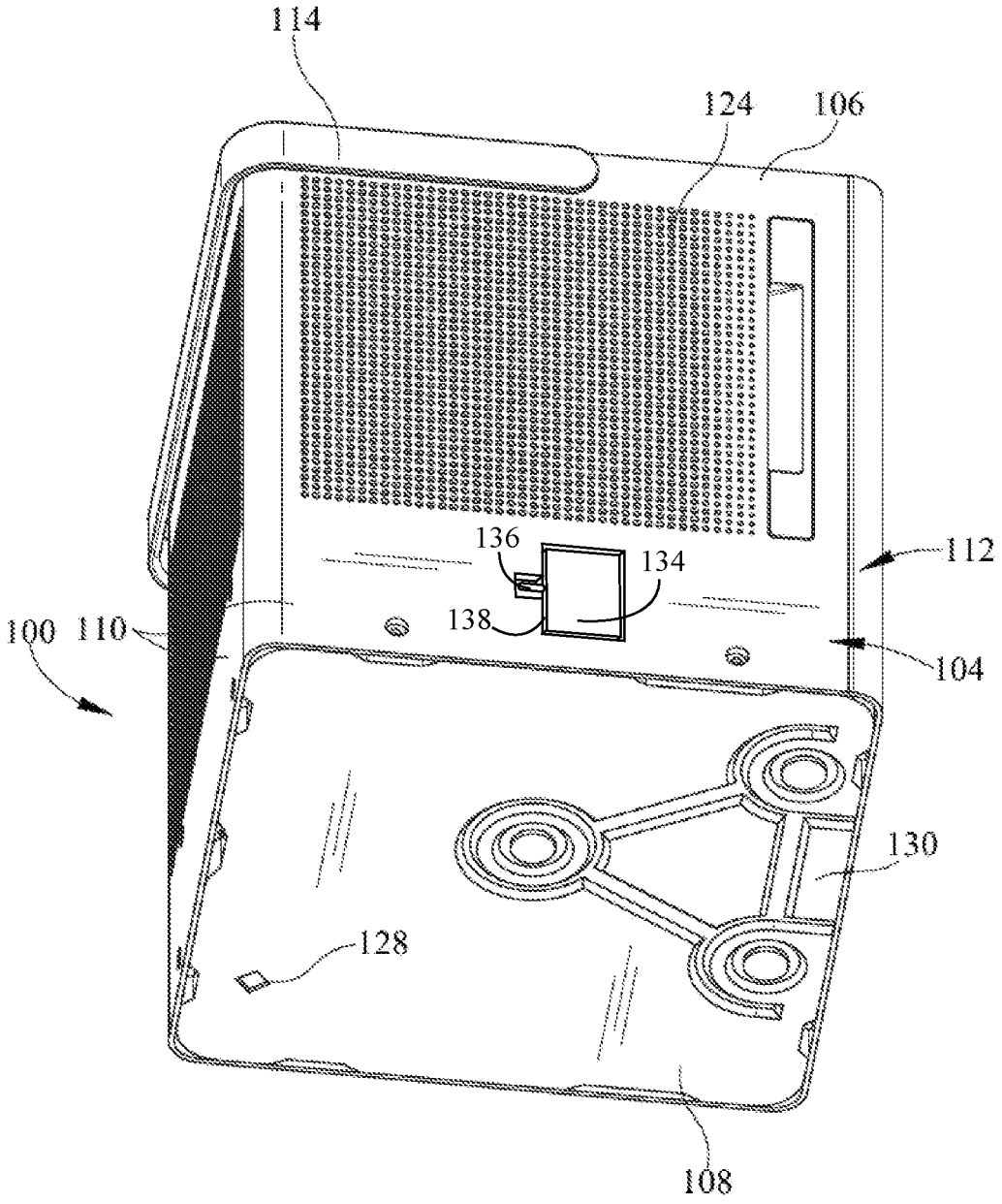
FIG. 2 is another perspective view of the portable dehumidifier of FIG. 1, illustrating a bottom of the portable dehumidifier.
Figure 3:
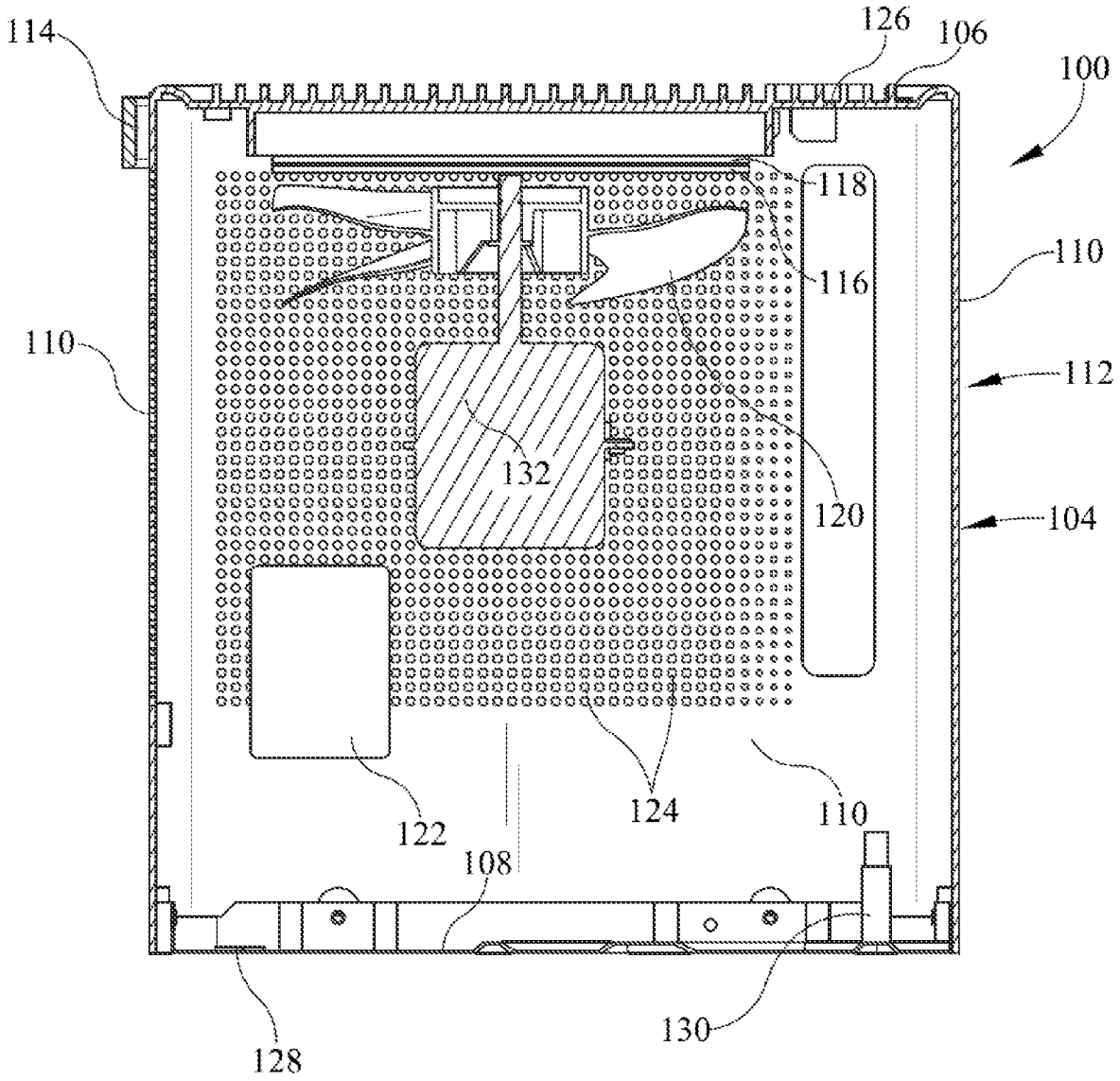
FIG. 3 is a cross-sectional view of the portable dehumidifier of FIG. 1, taken along lines 3-3 thereof.

Turning now to the drawings, wherein like numbers denote like parts throughout the several views, FIGS. 1-3 illustrate a condensing unit or a dehumidifier 100 consistent with some embodiments of the invention. Dehumidifier 100 in particular is a portable dehumidifier, e.g., principally for use in residential applications and capable of being readily moved from place to place, rather than being installed permanently or semi-permanently in a fixed location, e.g., secured to a wall, ceiling or other structure in a building. A portable dehumidifier within the context of the present disclosure generally has the characteristics of being readily movable, e.g., by carrying via one or more handles and/or by being rolled on one or more wheels that support the portable dehumidifier, as well as being readily connected to and disconnected from a source of power, e.g., via a power cord having a plug that may be received in a standard wall outlet.

While in other embodiments, dehumidifier 100 may include a condensate tank for collecting condensate, in the embodiment of FIGS. 1-3, dehumidifier lacks a condensate tank or other similar reservoir for collecting the condensate water, which enables dehumidifier 100 to more efficiently utilize a given space and provides for convenient storage, shipping, handling, operation, etc. In different embodiments, dehumidifier 100, or portions thereof, may be a variety of shapes, sizes, quantities, and constructions and still be within the scope of the disclosure. For example, in the embodiment as shown, a portable housing 104 of dehumidifier 100 may include a top wall 106 and/or an opposing bottom wall 108 interconnected by one or more side walls 110. The one or more side walls 110 may define one or more portions of the outer periphery 112. In some embodiments, and as shown in FIG. 3, dehumidifier 100 may include one or more of a condenser 116, an evaporator 118, a fan 120, a compressor 122, an air inlet 124, an air outlet 126, a condensate water outlet 128, a water level sensor 130, and/or a motor 132. Condenser 116, evaporator 118 and compressor 122 form a portion of a refrigeration circuit that circulates coolant or refrigerant driven by compressor 122 through condenser 116 and evaporator 118 in a vapor compression refrigeration cycle, while fan 120 is driven by motor 132 to draw air in through air inlet 124, across evaporator 118 to cool the incoming air and condense water vapor from the air, and then across condenser 116 to reheat the air before it exits through air outlet 126.

Dehumidifier 100, or portions thereof, may also include a handle 114. Handle 114, if used, may allow the user to transport, carry, store, and/or ship dehumidifier 100, or portions thereof. During operation, air inlet 124 and/or air outlet 126 may be uncovered and opened to control air flow communication through dehumidifier 100.

In various embodiments, condensate water outlet 128 may be positioned at different locations of dehumidifier 100 to direct the condensate water generated from moisture in the air to a drainage system. For example, in some embodiments, dehumidifier 100 may include one or more condensate water outlets 128 on bottom wall 108, as shown in FIGS. 2 and 3, to allow the condensate water to flow directly from dehumidifier 100 into a building drainage system (e.g., a floor drain, etc.). In such embodiments, during operation, dehumidifier 100 may be configured to be above a floor drain, within a utility sink, etc., and bottom wall 108 of dehumidifier 100 may be the base of dehumidifier 100 adjacent to the ground/sink surface, allowing the condensate water collected in dehumidifier 100 to drain directly into the drain and/or the sink by gravity.

In some other embodiments, dehumidifier 100, or portions thereof, may include one or more hose connection structures (not shown), and the hose connection structure (e.g. adaptors, fittings, gravity fed hose connection, etc.) may connect to a drainage system. In various embodiments, the hose connection structure may be positioned inside and/or outside of dehumidifier 100. For example, side wall 110 of dehumidifier 100 may include an opening (not shown) to pass a drainage pipe therethrough from a hose connection structure positioned outside of dehumidifier 100. In such embodiments, dehumidifier 100 may be adapted to connect condensate water outlet 128 to a drainage system via the drainage pipe (e.g., a hose). In such embodiments, the user may remove dehumidifier 100 from the hose connection structure once dehumidification process is over, and dehumidifier 100 is desired to be stored and/or transported.

In some embodiments, dehumidifier 100, or portions thereof, may also include one or more water level sensors 130 to determine a percentage/level of condensate water. The one or more water level sensors 130 may include a sonar, optical, electromechanical, mechanical, electrical, and/or float sensor. The water level sensor 130, if used, may be used to detect a water level height in a condensate bucket. In some embodiments, dehumidifier 100 may also include one or more built-in condensate pumps (not shown in FIGS. 1-3) to facilitate condensate water drainage. In some alternate embodiments, a separate condensate pump outside of dehumidifier 100 may be used to move the collected condensate water to a disposal location when gravity drainage is not feasible.

Consistent with the invention, dehumidifier 100 also includes a remote moisture sensor 134 coupled thereto via a cord or wire 136, and optionally docked within a dock 138 formed on a side wall 110 of the dehumidifier. A dock sensor 140 (FIG. 1) may be used to detect whether remote moisture sensor 134 is docked in or undocked from dock 138, and various manners of retaining remote moisture sensor 134 within dock 138 may be used in various embodiments, e.g., via one or more tabs or detents, via one or more magnets, or in various other manners that will be appreciated by those of ordinary skill having the benefit of the instant disclosure.

Furthermore, in addition to or in lieu of remote moisture sensor 134, portable dehumidifier 100 may include one or more wireless remote moisture sensors 142 that communicate wirelessly with a controller of portable dehumidifier 100, and that in some instances may be battery powered, and in some instances, rechargeable.

Each remote moisture sensor 134, 142 may be configured to sense air and/or surface moisture, and may utilize various moisture sensing technologies such as humidity sensing, continuity sensing, conductivity sensing, etc. In operation, each remote moisture sensor 134, 142 may be positioned at various physical locations that are physically separated from portable housing 104, and a controller may utilize outputs of such moisture sensor(s) to control the compressor and/or motor of the dehumidifier. In some instances, for example, it may be desirable to utilize an output of a remote moisture sensor 134, 142 to sense the dryness of clothing that is being air dried. Also, in some instances, it may be desirable to utilize an output of a remote moisture sensor 134, 142 to sense the dryness of floors, walls, furniture, and/or other surfaces after a flood, leak, drain blockage, etc., e.g., as part of water damage restoration. Other uses will be apparent to those of ordinary skill having the benefit of the instant disclosure.

Figure 4:
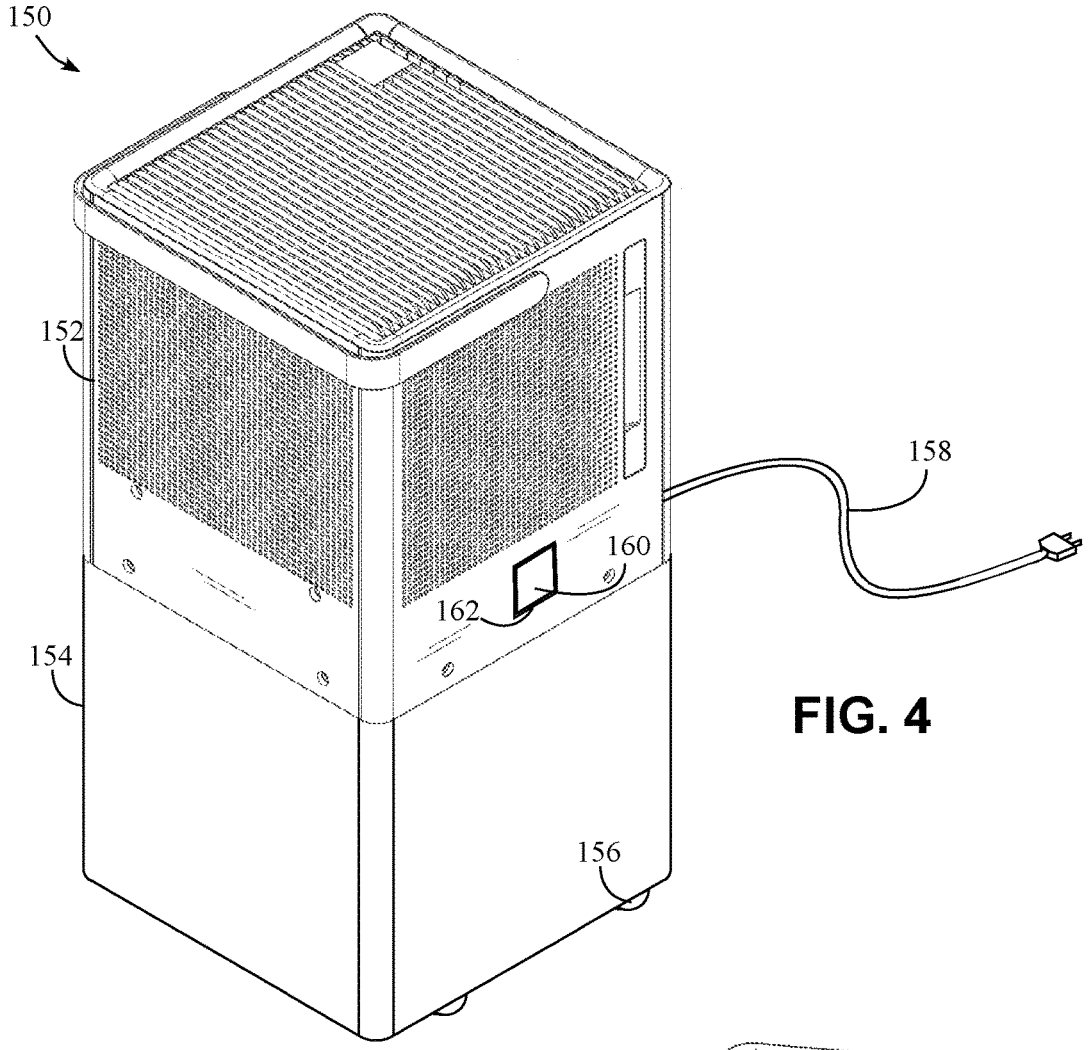
FIG. 4 is a perspective view of another portable dehumidifier incorporating a remote moisture sensor consistent with some embodiments of the invention.

Now turning to FIG. 4, as noted above, while portable dehumidifier 100 is a tankless design, in other embodiments, a condensate tank may be used. In particular, FIG. 4 illustrates a portable dehumidifier 150 that includes a portable housing 152 that further includes a condensate tank 154 for collecting condensate generated by the evaporator of the dehumidifier. Portable housing 152 also includes a plurality of wheels 156 for enabling the dehumidifier to be rolled from location to location, and a power cord 158 is configured to power the dehumidifier, e.g., by removably plugging the power cord into a standard power outlet. Portable dehumidifier 150 also includes a wireless remote moisture sensor 160 docked in a dock 162, and suitable for sensing moisture at various physical locations remote from portable housing 152.

Figure 5:
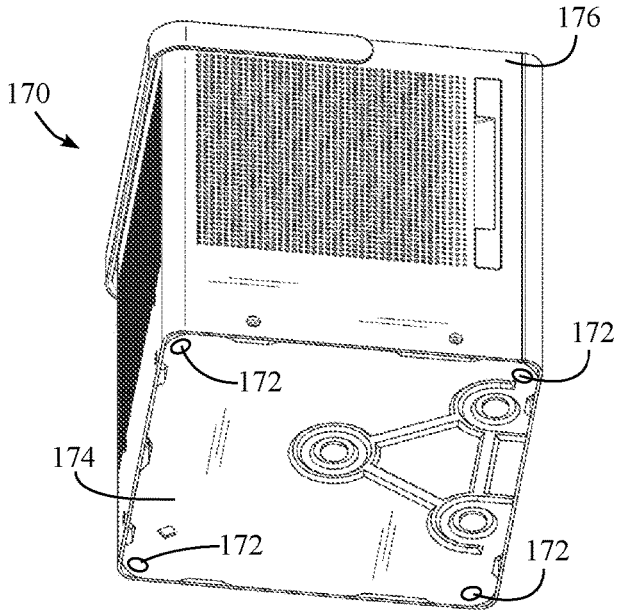
FIG. 5 is a perspective view of yet another portable dehumidifier consistent with some embodiments of the invention, and incorporating an integrated leakage detection system.

FIG. 5 illustrates another portable dehumidifier 170 that may include, in lieu of or in addition to a remote moisture sensor, one or more moisture sensors 172 positioned on a bottom 174 of a housing 176 of portable dehumidifier 170. In some instances, for example, moisture sensor(s) 172 may be integrated into housing 176, e.g., along an edge or on a bottom surface thereof, and positioned to sense moisture on a surface upon which housing 176 is supported. Moisture sensor(s) 172 may be used, for example, to detect water leaks due to basement flooding, clogged floor drains, leaking water heaters, etc., and as will be discussed in greater detail below, may be used to generate a user notification, e.g., an audio and/or visual alert, an electronic message, etc., in response to detecting moisture in such circumstances. It will be appreciated, in particular, that dehumidifiers are often located in rooms or areas where flooding and leaks may be encountered, so providing one or more remote and/or integrated moisture sensors on a dehumidifier to detect such circumstances may provide additional functionality beyond that of dehumidification.

Figure 6:
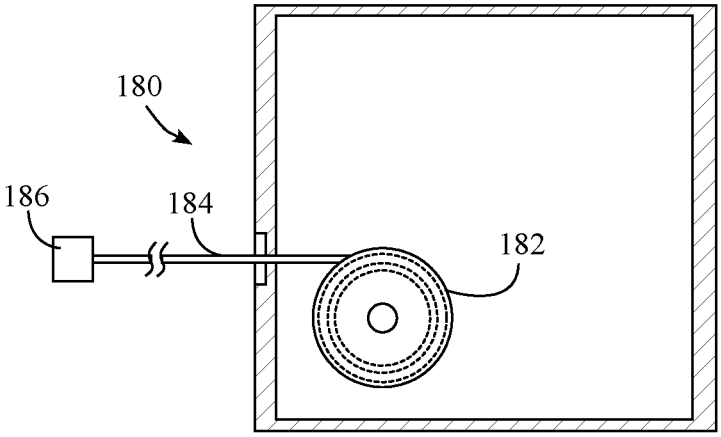
FIG. 6 is a cross-sectional view of another portable dehumidifier consistent with some embodiments of the invention, and incorporating a cord retractor.
Figure 7:
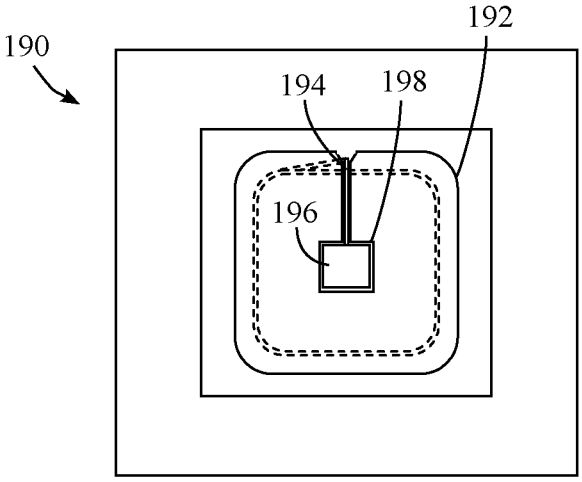
FIG. 7 is a side elevational view of another portable dehumidifier consistent with some embodiments of the invention, and incorporating a cord storage loop.

As noted above, a portable dehumidifier may utilize one or more wired remote moisture sensors in some embodiments. In some instances, a plug and socket arrangement may be used to removably couple a wire or cord of a remote moisture sensor to the housing of a portable dehumidifier, while in other embodiments, the wire or cord may be permanently affixed to the housing of a portable dehumidifier. Particularly (but not exclusively) in the latter embodiments, it may additionally be desirable to provide a manner of managing the wires or cords of such sensors when docked and/or not in use. As illustrated by portable dehumidifier 180 of FIG. 6, for example, it may be desirable to utilize a cord retractor 182 to automatically retract and extend a cord or wire 184 of a remote moisture sensor 186. Cord retractor 182 may, for example, enable a user to pull on cord or wire 184 to extend the cord or wire, and then, when desired, pull on cord or wire 184 enough to release a latch and enable the cord retractor 182 to automatically retract the cord or wire into the housing of portable dehumidifier 180. Various types of cord retractors, having various configurations, may be used, as will be understood by those of ordinary skill having the benefit of the instant disclosure. Alternatively, as illustrated by portable dehumidifier 190 of FIG. 7, a cord storage loop 192 may be used to support a wire or cord 194 of a remote moisture sensor 196. As illustrated in FIG. 7, for example, cord storage loop 192 may be recessed into a side wall of the housing of portable dehumidifier 190, and may enable a user to manually wind or unwind the wire or cord as desired. In addition, a dock 198 may be provided in some embodiments to enable remote moisture sensor 196 to be stored on the housing.

Figure 8:
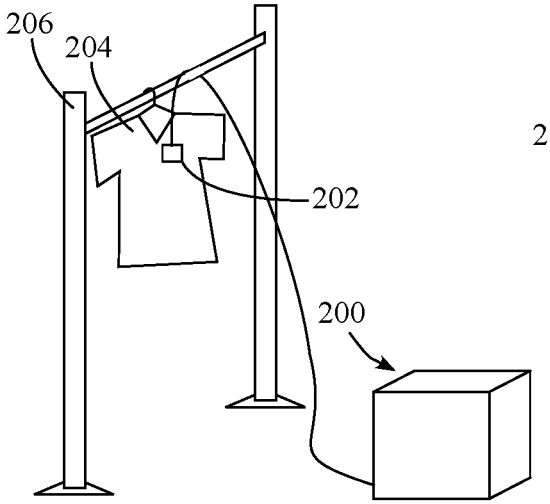
FIG. 8 is a perspective view illustrating use of the portable dehumidifier of FIG. 1 in a clothes drying application.

As noted above, one application of a portable dehumidifier as disclosed herein is in connection with accelerating the air drying of clothing. FIG. 8, for example, illustrates a portable dehumidifier 200 having a remote moisture sensor 202 positioned to sense moisture on or in the air in the immediate vicinity of a garment of clothing 204 while the garment is hanging up to dry, e.g., on a clothes rack 206, or alternatively, a drying rack, a clothesline, etc. While remote moisture sensor 202 may simply hang on or in the proximity of a garment of clothing in some embodiments, it may also be desirable to optimize the design of a remote moisture sensor for clothes drying applications.

Figure 9:
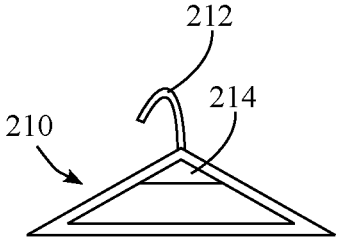
FIG. 9 is a partial view of a remote moisture sensor suitable for use in a portable dehumidifier consistent with some embodiments of the invention, and integrated into a coat hanger.
Figure 10:
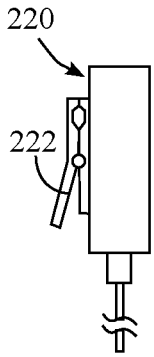
FIG. 10 is a partial view of another remote moisture sensor suitable for use in a portable dehumidifier consistent with some embodiments of the invention, and including a clip.

FIG. 9, for example, illustrates a coat hanger 210 including a hook 212 and a remote moisture sensor 214 (which may be wired or wireless) integrated therein. As such, a user may place a garment of clothing on the coat hanger 210 and remote moisture sensor 214 may be positioned to either contact a surface of the garment or to sense humidity of the air immediately in the vicinity of the garment. As another example, FIG. 10 illustrates a remote moisture sensor 220 that includes an integrated clip 222 that may be used to physically attach the remote moisture sensor to a garment or to a structure upon which the garment is being air dried. Other structures suitable for optimizing the placement of a remote moisture sensor on or near a garment of clothing may be used in other embodiments, as will be appreciated by those of ordinary skill having the benefit of the instant disclosure.

Figure 11:
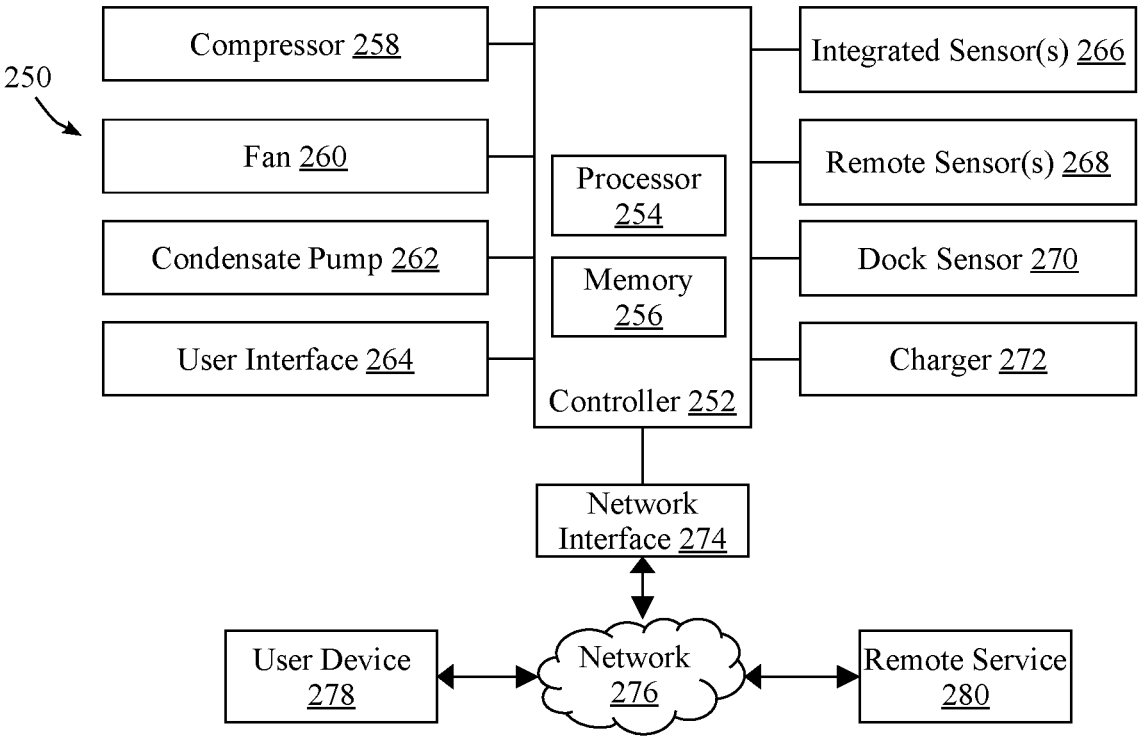
FIG. 11 is a block diagram of an example control system for a portable dehumidifier consistent with some embodiments of the invention.

Now turning specifically to FIG. 11, a portable dehumidifier 250 consistent with some embodiments of the invention may be under the control of a controller 252 that receives inputs from a number of components and drives a number of components in response thereto. Controller 252 may, for example, include one or more processors 254 and a memory 256 within which may be stored program code for execution by the one or more processors 254. The memory may be embedded in controller 252, but may also be considered to include volatile and/or non-volatile memories, cache memories, flash memories, programmable read-only memories, read-only memories, etc., as well as memory storage physically located elsewhere from controller 252, e.g., in a mass storage device or on a remote computer interfaced with controller 252. Controller 252 may also be implemented as a microcontroller in some embodiments, and as such these terms are used interchangeably herein. Controller 252 may also include discrete circuit logic in some embodiments, e.g., including passive and/or active circuit components.

As shown in FIG. 11, controller 252 may be interfaced with various components, including a compressor 258 that drives a refrigeration circuit, a fan 260 that draws air through the dehumidifier, and in some instances, a condensate pump 262 that is capable of pumping collected water to a drain or other destination. In addition, one or more user interfaces 264, e.g., including various input/output devices such as knobs, dials, sliders, switches, buttons, lights, textual and/or graphics displays, touch screen displays, speakers, image capture devices, microphones, etc., may be used for receiving input from and communicating with one or more users.

In addition, controller 252 may be coupled to one or more integrated sensors 266 and/or one or more remote sensors 268. An integrated sensor 266 may be integrated in some manner into the main unit or housing of the portable dehumidifier, and thus may be local to the dehumidifier itself. An integrated sensor 266, for example, may be implemented as a room humidity sensor that is configured to sense the overall humidity level within a room or other area in which the portable dehumidifier is located. A remote sensor 268 may be any type of sensor that is coupled wirelessly or through a wire to the main unit or housing of the portable dehumidifier, but that is capable of being positioned some distance away from the main unit or housing, limited, for example, by the length of the wire or cord coupling the sensor to the main unit or housing, or by the wireless communication range between the main unit or housing and the remote sensor. An integrated or remote sensor may sense various environmental conditions, e.g., humidity, temperature, surface moisture, etc., and it will be appreciated in some portable dehumidifiers consistent with the invention, an integrated sensor or a remote sensor may be omitted. In some embodiments, for example, a moisture sensor may be capable of sensing air moisture (in the form of humidity, e.g., a hygrometer) and/or surface moisture (in the form of liquid water, e.g., a conductivity sensor, continuity sensor or other water detector). It will be appreciated that a moisture sensor in some embodiments may be implemented as a contact-type sensor, whereby moisture on a surface (or in the air) is sensed via contact of the sensor with the surface (or air) itself.

In addition, in some embodiments, additional sensors may be provided, e.g., a dock sensor 270 capable of detecting when a remote moisture sensor is or is not docked in a dock provided on a housing of the portable dehumidifier. A dock sensor may be configured to sense presence of a remote moisture sensor via magnetic sensing, via optical sensing, via a mechanical switch, or in other suitable manners of detecting presence, as will be known to those of ordinary skill having the benefit of the instant disclosure.

Further, where a remote moisture sensor is wireless, it may also be desirable to include a charger 272 capable of charging a battery of the remote moisture sensor when it is docked in a dock, e.g., via wireless charging or via charging contacts on the remote moisture sensor.

In some embodiments, controller 252 may also be coupled to one or more network interfaces 274, e.g., for interfacing with external devices via wired and/or wireless networks 276 such as Ethernet, Bluetooth, NFC, cellular and other suitable networks. It may be desirable, for example, to interface with one or more user devices 278, e.g., a user's mobile phone, to enable a user to change settings on the portable dehumidifier and/or receive notifications such as drying complete notifications. It may also be desirable to interface with various remote services 280. Moreover, in some embodiments, at least a portion of controller 252 may be implemented externally, e.g., within a mobile device, a cloud computing environment, etc., such that at least a portion of the functionality described herein is implemented within the portion of the controller that is externally implemented.

In some embodiments, controller 252 may operate under the control of an operating system and may execute or otherwise rely upon various computer software applications, components, programs, objects, modules, data structures, etc. In addition, controller 252 may also incorporate hardware logic to implement some or all of the functionality disclosed herein. Further, in some embodiments, the sequences of operations performed by controller 252 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 12:
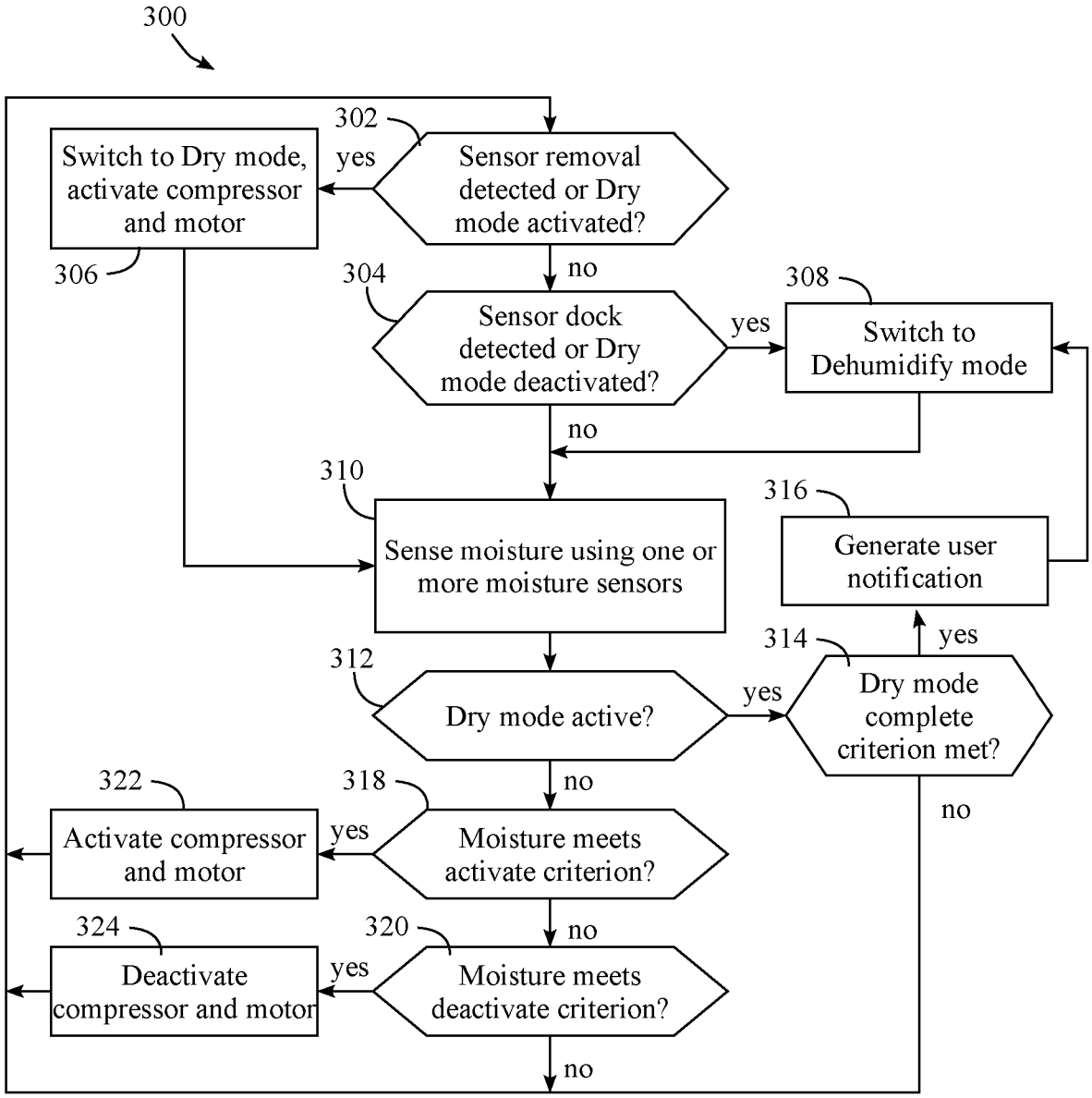
FIG. 12 illustrates an example sequence of operations for operating the portable dehumidifier of FIG. 11.

FIG. 12 next illustrates an example sequence of operations 300 for operating a portable dehumidifier such as portable dehumidifier 250 of FIG. 11. In this embodiment, a controller of the portable dehumidifier may support at least Dehumidify and Dry modes, with the former used to dehumidify a room or area in a dwelling or other structure based upon one or more general area humidity calculations generated from the outputs of one or more moisture sensors, and with the latter used to dry clothing, floors, walls, furniture, or other surfaces of a structure based upon the outputs of one or more moisture sensors that are in contact with or in close proximity to the surface(s) for which it is intended to dry. In some embodiments, multiple Dry modes may be supported, e.g., separate Dry modes for clothing and for water damage restoration.

In the illustrated embodiment, the Dehumidify mode may be considered to operate based upon a room humidity control algorithm that utilizes the output of one or more moisture sensors, e.g., one or more remote moisture sensors and/or one or more integrated moisture sensors, to control a compressor and motor of a portable dehumidifier to attempt to maintain a desired humidity level in the room or other area in which a portable dehumidifier is disposed. In one example algorithm, for example, a humidity level setpoint may be selected by a user, e.g., in terms of % relative humidity, and activate and deactivate criteria may be defined to establish when to activate and deactivate a compressor and motor in order to maintain a desired humidity level, e.g., to activate the compressor and motor when the sensed humidity level is X % greater than the humidity level setpoint and deactivate the compressor and motor when the sensed humidity level is Y % below the humidity level setpoint. In some embodiments, the sensed humidity level may be based upon multiple sensor outputs, e.g., by averaging the outputs of sensors positioned in different areas of a room and/or an integrated sensor disposed in the portable dehumidifier housing. Further, in some embodiments the motor speed, and thus the rate of air flow, may also be controlled based upon a room humidity control algorithm, although in other embodiments a motor speed may be controlled via a user control, such that the algorithm only controls whether the fan is or is not active at any given time.

The Dry mode may be considered to operate based upon a dry control algorithm that utilizes the output of one or more moisture sensors, e.g., one or more remote moisture sensors and/or one or more integrated moisture sensors, to control a compressor and motor of a portable dehumidifier to attempt to reach a desired moisture level or level of dryness on or in the immediate proximity of the one or more moisture sensors. For a water detection-type sensor, for example, the desired moisture level may be a loss of conductivity or continuity due to the absence of water in contact with the moisture sensor. For a humidity-type sensor, the desired moisture level may be associated with a humidity level that indicates a suitable level of dryness.

In the illustrated embodiment of FIG. 12, the Dry mode differs from the Dehumidify mode in that, rather than cycling the compressor and motor on and off in order to maintain a desired room humidity level, the Dry mode is configured to run continuously until a Dry mode complete criterion is met, e.g., when a moisture level setpoint has been reached. At that point, the drying operation is complete, and in some instances, the portable dehumidifier may revert to the Dehumidify mode and/or generate a user notification to alert a user to the completed status of the drying operation. In some embodiments, a Dry mode may have a user-configurable moisture level setpoint, while in other embodiments, the setpoint may not be configurable. In addition, in some embodiments, a Dry mode may simply utilize a room humidity control algorithm, but with the humidity level setpoint set well below a level that the portable dehumidifier could reasonably be able to reach (e.g., a minimum humidity level for the portable dehumidifier), such that the portable humidifier will run at full output continuously until the desired level of drying has occurred.

In addition, in the embodiment of FIG. 12, selection of a Dehumidify mode or a Dry mode may be made in multiple manners. First, a user may be able to specify a desired mode, e.g., through a user interface on a housing of the portable dehumidifier, through a mobile app, etc. Second, the mode may be automatically selected based upon a docked/undocked status of a remote moisture sensor capable of being docked in a dock on the housing of the portable dehumidifier. Thus, for example, if the remote moisture sensor is docked in the housing, the Dehumidify mode may be used, and the remote moisture sensor may be used as a room humidity sensor, or potentially disabled if an integrated moisture sensor operating as a room humidity sensor is disposed on the housing (although in some instances a remote moisture sensor could be used in combination with an integrated moisture sensor if both are provided). Then, once the remote moisture sensor is removed, the portable dehumidifier may automatically transition to the Dry mode and control the compressor and motor based upon moisture detected on or in the immediate proximity of the remote moisture sensor, and generally with any room humidity sensor on the housing of the portable dehumidifier disabled. It will be appreciated, however, that in some embodiments, no automatic mode selection may be used, while in other embodiments, only automatic mode selection may be supported.

Sequence 300 therefore begins in blocks 302 and 304 by determining whether a mode change should be performed to transition between the Dehumidify and Dry modes. Specifically, block 302 determines if removal of the remote moisture sensor from the dock has been detected, or if the user has activated the Dry mode. If so, control passes to block 306 to switch to the Dry mode, and activate the compressor and motor to run at full output. Similarly, block 304 determines if docking of the remote moisture sensor into the dock has been detected, or if the user has deactivated the Dry mode (or otherwise activated the Dehumidify mode). If so, control passes to block 308 to switch to the Dehumidify mode.

If neither of the conditions in blocks 302, 304 have been met, or at the completion of either block 306 or 308, control passes to block 310 to sense moisture using one or more moisture sensors. It will be appreciated that which sensor is used may depend on the active mode in some embodiments, while in other embodiments multiple sensor outputs may be used.

Next, block 312 determines whether the Dry mode is active, and if it is, control passes to block 312 to implement the dry control algorithm and determine whether the Dry mode complete criterion has been met based upon the sensed moisture from block 310. If not, control returns to block 302 to continue to operate the portable dehumidifier in the Dry mode. If the Dry mode complete criterion is met, however, the drying operation is complete, and block 314 passes control to block 316 to optionally generate a user notification, e.g., by generating an audio and/or visual indication on the user interface of the portable dehumidifier, by sending an electronic message such as a text message, an email message, by presenting a message on a smart assistant device, etc. Control then passes to block 308 to deactivate the Dry mode and activate the Dehumidify mode.

Returning to block 312, if the Dry mode is not active, control passes instead to blocks 318 and 320 to implement the room humidity control algorithm and selectively activate/deactivate the compressor and motor of the portable dehumidifier in order to maintain a desired humidity level in the room or area within which the portable dehumidifier is disposed. Block 318, in particular, determines if the sensed moisture meets an activate criterion (e.g., a humidity level above a humidity level setpoint), and if so, passes control to block 322 to activate the compressor and motor and return control to block 302. Block 320 determines if the sensed moisture meets a deactivate criterion (e.g., a humidity level below a humidity level setpoint), and if so, passes control to block 324 to activate the compressor and motor and return control to block 302. If neither criterion is met, the compressor and motor stay in their same states, and control returns to block 302.

Other modifications may be made to the illustrated embodiments without departing from the spirit and scope of the invention. Therefore, the invention lies in the claims hereinafter appended.

What is claimed is:

1. A portable dehumidifier, comprising:

a portable housing including an air inlet and an air outlet;

a refrigeration circuit disposed in the housing and including a condenser, an evaporator, and a compressor;

a fan driven by a motor and configured to draw air in through the air inlet, past the evaporator and the condenser, and out the air outlet;

a remote moisture sensor configured to be physically positioned at a location that is remote from the portable housing to sense moisture at the location; and a controller coupled to the compressor and the motor and in communication with the remote moisture sensor, the controller configured to drive the refrigeration circuit with the compressor and drive the fan with the motor in response to moisture sensed by the remote moisture sensor;

wherein the controller is configured to operate in at least dehumidify and dry modes, wherein the controller is configured to operate in the dehumidify mode by performing a dehumidify operation that controls the compressor and the motor based upon a room humidity control algorithm to maintain a desired room humidity level, and to operate in the dry mode by performing a drying operation that controls the compressor and the motor based upon a dry control algorithm until a dry mode complete criterion has been reached.

2. The portable dehumidifier of claim 1, wherein the controller is configured to perform the dehumidify operation by cycling the compressor and the motor to maintain the desired room humidity level and to perform the drying operation by running the compressor and the motor continuously until the dry mode complete criterion has been reached.

3. The portable dehumidifier of claim 1, wherein the controller is configured to automatically revert to the dehumidify mode from the dry mode in response to an output of the remote moisture sensor meeting the dry mode complete criterion.

4. The portable dehumidifier of claim 1, wherein the controller is configured to determine that the dry mode complete criterion is met by determining that a surface moisture sensed by the remote moisture sensor meets the dry mode complete criterion.

5. The portable dehumidifier of claim 1, wherein the remote moisture sensor comprises a humidity sensor configured to sense air moisture.

6. The portable dehumidifier of claim 1, wherein the remote moisture sensor comprises a conductivity sensor or a continuity sensor configured to sense surface moisture.

7. The portable dehumidifier of claim 1, wherein the remote moisture sensor includes a clip and/or a hook to support the remote moisture sensor at the location.

8. The portable dehumidifier of claim 1, wherein the remote moisture sensor is integrated into a coat hanger.

9. The portable dehumidifier of claim 1, wherein the remote moisture sensor is coupled to the portable housing through a cord.

10. The portable dehumidifier of claim 9, wherein the portable housing includes a cord retractor configured to automatically retract the cord into the portable housing.

11. The portable dehumidifier of claim 9, wherein the portable housing includes a cord storage loop for storing the cord on the portable housing.

12. The portable dehumidifier of claim 1, wherein the remote moisture sensor is in wireless communication with the controller.

13. The portable dehumidifier of claim 1, wherein the portable housing includes a dock configured to receive the remote moisture sensor.

14. The portable dehumidifier of claim 13, further comprising a dock sensor coupled to the controller and configured to detect whether the remote moisture sensor is docked in the dock.

15. The portable dehumidifier of claim 14, wherein the controller is configured to automatically switch from the dehumidify mode to the dry mode in response to the dock sensor detecting the remote moisture sensor being undocked from the dock.

16. The portable dehumidifier of claim 14, wherein the controller is configured to automatically switch from the dry mode to the dehumidify mode in response to the dock sensor detecting the remote moisture sensor being docked to the dock.

17. The portable dehumidifier of claim 14, wherein the controller is configured to use the remote moisture sensor as a room humidity sensor when in the dehumidify mode.

18. The portable dehumidifier of claim 1, further comprising a room humidity sensor coupled to the portable housing and coupled to the controller.

19. The portable dehumidifier of claim 18, wherein the controller is configured to only use the room humidity sensor when operating in the dehumidify mode, and only use the remote moisture sensor when operating in the dry mode.

20. The portable dehumidifier of claim 18, wherein the controller is configured to concurrently use both of the room humidity sensor and the remote moisture sensor to control the compressor and the motor.

21. The portable dehumidifier of claim 1, wherein the remote moisture sensor is positionable on or proximate clothing to sense a moisture level on or proximate the clothing.

22. The portable dehumidifier of claim 1, wherein the remote moisture sensor is positionable on a wall, a floor and/or a piece of furniture.

23. The portable dehumidifier of claim 1, wherein the controller is configured to automatically shut off the compressor and the motor in response to an output of the remote moisture sensor meeting the dry mode complete criterion.

24. The portable dehumidifier of claim 1, wherein the controller is configured to generate a user notification in response to an output of the remote moisture sensor meeting the dry mode complete criterion.

25. A portable dehumidifier, comprising:

a portable housing including an air inlet and an air outlet;

a refrigeration circuit disposed in the housing and including a condenser, an evaporator, and a compressor;

a fan driven by a motor and configured to draw air in through the air inlet, past the evaporator and the condenser, and out the air outlet;

a moisture sensor comprising a water detector disposed on a bottom of the portable housing and positioned to sense liquid water on a surface upon which the portable housing is supported; and a controller coupled to the compressor and the motor and in communication with the moisture sensor, the controller configured to drive the refrigeration circuit with the compressor and generate a user notification in response to liquid water sensed by the moisture sensor.

26. The portable dehumidifier of claim 25, wherein the moisture sensor is a first moisture sensor disposed on a first portion of the bottom of the portable housing, and the portable dehumidifier includes one or more additional moisture sensors disposed at different portions of the bottom of the portable housing.

27. A portable dehumidifier, comprising:

a portable housing including an air inlet and an air outlet;

a refrigeration circuit disposed in the housing and including a condenser, an evaporator, and a compressor;

a fan driven by a motor and configured to draw air in through the air inlet, past the evaporator and the condenser, and out the air outlet;

a remote moisture sensor configured to be physically positioned at a location that is remote from the portable housing to sense moisture at the location, wherein the portable housing includes a dock configured to receive the remote moisture sensor;

a controller coupled to the compressor and the motor and in communication with the remote moisture sensor, the controller configured to drive the refrigeration circuit with the compressor and drive the fan with the motor in response to moisture sensed by the remote moisture sensor; and a dock sensor coupled to the controller and configured to detect whether the remote moisture sensor is docked in the dock.

* * * * *